US007198874B2

(12) United States Patent
Saito et al.

(10) Patent No.: US 7,198,874 B2
(45) Date of Patent: Apr. 3, 2007

(54) TONER, METHOD OF MAKING, METHOD OF USING

(75) Inventors: Takuya Saito, Numazu (JP); Hiroshi Yamashita, Numazu (JP); Yohichiroh Watanabe, Fuji (JP); Tsunemi Sugiyama, Numazu (JP)

(73) Assignee: Ricoh Company, Ltd.,, Tokyo (JP)

( * ) Notice: Subject to any disclaimer, the term of this patent is extended or adjusted under 35 U.S.C. 154(b) by 0 days.

(21) Appl. No.: 11/396,687

(22) Filed: Apr. 4, 2006

(65) Prior Publication Data

US 2006/0172214 A1 Aug. 3, 2006

Related U.S. Application Data

(63) Continuation of application No. 10/802,866, filed on Mar. 18, 2004, now Pat. No. 7,074,535.

(30) Foreign Application Priority Data

Mar. 19, 2003 (JP) ..... 2003-075828

(51) Int. Cl.
*G03G 9/00* (2006.01)

(52) U.S. Cl. ..... 430/108.11; 430/108.14; 430/108.15; 430/109.4; 430/137.15

(58) Field of Classification Search ..... 430/108.11, 430/108.14, 108.15, 109.4, 137.15
See application file for complete search history.

(56) References Cited

U.S. PATENT DOCUMENTS

| | | | | |
|---|---|---|---|---|
| 3,104,883 | A | 9/1963 | English et al. | |
| 3,258,750 | A | 6/1966 | Shew | |
| 6,503,676 | B2 | 1/2003 | Yamashita et al. | |
| 6,593,048 | B2 | 7/2003 | Sasaki et al. | |
| 6,653,037 | B2 | 11/2003 | Sawada et al. | |
| 6,660,443 | B2 | 12/2003 | Sugiyama et al. | |
| 6,667,141 | B2 | 12/2003 | Iwamoto et al. | |
| 6,682,866 | B2 | 1/2004 | Sugiyama et al. | |
| 6,699,632 | B2 | 3/2004 | Higuchi et al. | |
| 6,946,229 | B2 | 9/2005 | Suzuki et al. | |
| 7,074,535 | B2 * | 7/2006 | Saito et al. | 430/108.11 |
| 2004/0115551 | A1 | 6/2004 | Sugiyama et al. | |
| 2004/0131961 | A1 | 7/2004 | Watanabe et al. | |

FOREIGN PATENT DOCUMENTS

| | | |
|---|---|---|
| JP | 63-186253 | 1/1988 |
| JP | 05-107808 | 4/1993 |
| JP | 06-242632 | 9/1994 |
| JP | 11-133665 | 5/1999 |
| JP | 11-149180 | 6/1999 |
| JP | 2000-292981 | 10/2000 |

* cited by examiner

*Primary Examiner*—Mark A. Chapman
(74) *Attorney, Agent, or Firm*—Oblon, Spivak, McClelland, Maier & Neustadt, P.C.

(57) ABSTRACT

The present invention relates to a toner useful, for example, for visualizing an electrostatic latent image formed on an image bearing member by a method such as electrophotography and electrostatic recording methods.

6 Claims, No Drawings

TONER, METHOD OF MAKING, METHOD OF USING

CROSS REFERENCES TO RELATED APPLICATIONS

This application is a continuation of U.S. patent application Ser. No. 10/802,866, filed on Mar. 18, 2004, now allowed.

BACKGROUND OF THE INVENTION

1. Field of the Invention

The present invention relates to a toner useful, for example, for visualizing an electrostatic latent image formed on an image bearing member by a method such as electrophotography and electrostatic recording methods. In addition, the present invention also relates, without limitation, to a developer including a toner, a developing method using a toner and a method of preparing the toner.

Additional advantages and other features of the present invention will be set forth in part in the description that follows and in part will become apparent to those having ordinary skill in the art upon examination of the following or may be learned from the practice of the present invention. The advantages of the present invention may be realized and obtained as particularly pointed out in the appended claims. As will be realized, the present invention is capable of other and different embodiments, and its several details are capable of modifications in various obvious respects, all without departing from the present invention. The description is to be regarded as illustrative in nature, and not as restrictive.

2. Discussion of the Background

Electrostatic latent images and magnetic latent images, which are formed on an image bearing member of an electrophotographic image forming apparatus or electrostatic recording apparatus are developed with a toner to be visualized.

For example, in electrophotography visual images are typically formed as follows:

(1) an electrostatic latent image is formed on a photoreceptor;

(2) the electrostatic latent image is developed with a developer including a toner to form a toner image on the photoreceptor;

(3) the toner image is transferred onto a receiving material such as papers; and (4) the toner image on the receiving material is fixed upon application of heat, etc. to form a hard copy.

Recently, a need exists for an electrophotographic image forming apparatus and a developer therefor, which can produce high quality images. In order to produce high quality images, it is essential for the toner included in a developer to have a sharp particle diameter distribution because each of the toner particles can exhibit uniform performance and thereby fine dot images can be well reproduced.

The toners used for developing electrostatic latent images are colored particles typically including a binder resin, and a colorant, a charge controlling agent and additives which are dispersed in the binder resin. The methods for manufacturing the toners are broadly classified into pulverization methods and suspension polymerization methods.

Pulverization methods typically include the following processes:

(1) mixing a colorant, a charge controlling agent, an offset preventing agent and the like materials with a thermoplastic resin upon application of heat thereto to knead the toner constituents;

(2) cooling the kneaded mixture;

(3) pulverizing the kneaded mixture to form a color powder; and (4) classifying the color powder to form a toner.

The toners prepared by pulverization methods have fair characteristics. However, the pulverization methods have a drawback in that only limited materials can be used as the toner constituents (particularly, as the binder resin). Namely, the kneaded mixture has to be easily pulverized and classified by conventional low-cost pulverizers and classifiers. From this point of view, the kneaded mixture has to be so brittle as to be pulverized. Therefore, the color powder, which is prepared by pulverizing a kneaded mixture, tends to have a broad particle diameter distribution. In order to prepare toner images having good resolution and half tone properties, the color powder has to be classified so as to have a particle diameter of from 5 to 20 μm. Therefore the toner yield is very low in the classification process.

In addition, it is impossible to uniformly disperse a colorant and a charge controlling agent in a thermoplastic resin when the pulverization methods are used. Uneven dispersion of toner constituents adversely affects the fluidity, developing properties, durability and image qualities of the resultant toner.

In attempting to solve such problems, suspension polymerization methods have been proposed and practically used now. The techniques for manufacturing a toner utilizing a polymerization method are known. However, the particles of toners prepared by suspension polymerization methods have a spherical form and therefore the toners have a drawback of having a poor cleaning property. When toner images have a low image area share (i.e., the percentage of the area of a toner image in a copy sheet is low), the amount of the toner particles remaining on a photoreceptor is small, and therefore a cleaning problem hardly occurs. However, when toner images have a high image area share (for example, copies of photograph images) are produced or when a toner image remains on a photoreceptor without being transferred to a receiving material due to paper jamming problems or the like, a large amount of the toner particles remains on the photoreceptor, resulting in occurrence of background fouling in the resultant or following images. In this case, when a contact charging roller is used, the toner particles remaining on the photoreceptor contaminate the charging roller, resulting in deterioration of the charging ability of the charging roller.

In attempting to solve such a problem, Japanese Patent No. 2,537,503 discloses a method in which resin particles prepared by an emulsion polymerization method are associated to prepare toner particles having an irregular form. However, the toner particles prepared by such an emulsion polymerization method include a large amount of a surfactant on or in the toner particles even after the toner particles are washed with water. Therefore, the resultant toner has poor charge stability when environmental conditions change and in addition the distribution of the charge quantity of the toner particles is broad, thereby causing background fouling in copy images. In addition, the remaining surfactant contaminates the photoreceptor and charging roller, developing roller and the like elements used in image forming apparatus, resulting in deterioration of the abilities of the elements.

Japanese Laid-Open Patent Publication No. 11-133665 discloses a toner including modified polyester having a Wadell practical sphericity of from 0.90 to 1.00.

Japanese Laid-Open Patent Publications Nos. 11-149180 and 2000-292981 disclose a dry toner and a method of producing the toner including a binder formed from an elongation and/or a crosslinking reaction of a prepolymer including an isocyanate group, and a colorant, wherein the dry toner is formed of particles formed from an elongation and/or a crosslinking reaction of the prepolymer (A) by amines (B) in an aqueous medium. However, the toner does not have both the transferability and cleanability.

Adding an inorganic particle such as a silica or titanium as the way of giving a charging to toner particles is known. However, these minute particles are buried inside the toner particles by being stirred in the developer for a long time, and the charging stability with the passage of time isn't assured. Making an inorganic particle fixed on the surface of the toner by mechano-chemical disposal is known, too. However, a bad influence is given to a fixation character because the surface of the toner becomes a film by the minute particle.

In addition, toners comprising a charge control agent in the toner composition are known. However, the charge control agent does not disperse in uniformly. Therefore, the electrostatic charge is unstable.

The use of fluorine in adjusting charge is known. For example, there is an approach to alter the toner surface with fluorine by adsorption or chemically or physically, for example using a fluorine-type surfactant. Such treatment can alter the electrostatic charge stability of toner particle, but the amount of carbon atom and fluorine atom as measured by XPS is important. When F/C is less than 0.01, there is little or no benefit, and 0.50 may be too high.

SUMMARY OF THE INVENTION

The present invention provides a high fluidity toner having good low-temperature fixing properties and good hot offset properties. At the same time, electrostatic charge stability is good. The invention toner further provides image sharpness over the long term.

DETAILED DESCRIPTION OF THE PREFERRED EMBODIMENTS

At first, the physical properties and main toner constituents used in the present invention will be explained in detail.

The present invention toner has fluoring on the surface thereof, providing electrostatic charge stability over time. The amount of F as compared to C on the toner surface as measured by XPS is important. Preferably, F/C is $0.01 \leqq F/C \leqq 0.50$, preferably $0.05 \leqq F/C \leqq 0.30$, most preferably $0.10 \leqq F/C \leqq 0.20$, including values of 0.15, 0.3.4, etc and all values and subranges between all values. To introduce fluorine to the toner face, the granulated body after particle formation of the toner composition may be agitated in an aqueous dispersion of a fluorine-containing surfactant. The surfactant can be cationic or anionic, for example, and can be used in combination with an electrostatic charge control agent.

The size of the dispersion is preferably less than 1 μm as is the size of any fine particles of electrostatic charge control agent. Resin fine particles are preferable as electrostatic charge control agents when provided on the toner face.

By using a surfactant having a fluoroalkyl group, dispersion having good dispensability can be prepared even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylgl-utamate, sodium 3-{omega-fluoroalkanoyl (C6–C11) oxy}-1-alkyl(C3–C4) sulfonate, sodium 3-{omega-fluoroalkanoyl(C6–C8)-N-ethylamino}-1-propanes-sulfonate, fluoroalkyl(C11–C20) carboxylic acids and their metal salts, perfluoroalkylcarboxylic acids and their metal salts, perfluoroalkyl(C4–C12)sulfonate Moreover, their metal salts, perfluorooctanesulfonic acid diethanol amides, N-propyl-N-(2-hydroxyethyl-)perfluorooctanesulfone amide, perfluoroalkyl(C6–C10)sulfoneamidepropyltri-methylammonium salts, salts of perfluoroalkyl (C6–C10)-N-ethylsulfonyl glycin, monoperfluoroalkyl(C6–C16)ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNTDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can be used for dispersing an oil phase including toner constituents in water, include primary, secondary and tertiary aliphatic amines having a fluoroalkyl group, aliphatic quaternary ammonium salts such as perfluoroalkyl(C6–C10)sulfoneamidepropyltrimethylammonium salts, benzalkonium salts, benzetonium chloride, pyridinium salts, imidazolinium salts, etc.

Specific examples of the marketed products thereof include

SURFLON S-121 (from Asahi Glass Co., Ltd.);

FRORARD FC-135 (from Sumitomo 3M Ltd.);

UNIDYNE DS-202 (from Daikin Industries, Ltd.);

MEGAFACE F-150 and F-824 (from Dainippon Ink and Chemicals, Inc.);

ECTOP EF-132 (from Tohchem Products Co., Ltd.);

FUTAKGENT F-300 (from Neos); etc.

A preferred material is the fluorine component ammonium salt compound shown with general formula (1).

[Chemical formula 1]

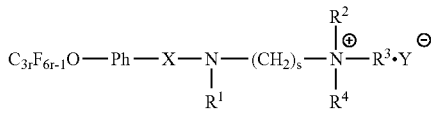

X:—$SO_2$— or —CO—;

$R^1$, $R^2$, $R^3$, $R^4$: hydrogen atom, alkyl group or aryl of carbon number 1–10, Y: I or Br,
r, s: an integer of 1–20.

Other useful surfactants that can be used in addition to fluorine-containing surfactants include:
alkylbenzene sulfonic acid salts,
α-olefin sulfonic acid salts, and
phosphoric acid salts;

cationic surfactants such as
amine salts (e.g., alkyl amine salts, aminoalcohol fatty acid derivatives, polyamine fatty acid derivatives and imidazoline),
and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride);

nonionic surfactants such as
fatty acid amide derivatives,
polyhydric alcohol derivatives; and ampholytic surfactants such as
alanine,
dodecyldi(aminoethyl)glycin,
di(octylaminoethyle)glycin, and
N-alkyl-N,N-dimethyl ammonium betaine.

In the present invention the ratio (Dv/Dn) (volume average particle diameter/number average particle diameter) is controlled.

The volume average particle diameter (Dv) of the toner of the present invention is preferably from 3 to 7 μm, and the ratio of Dv/Dn of the volume average particle diameter (Dv) to the number average particle diameter (Dn) is preferably not greater than 1.25, more preferably from 1.03 to 1.15. When such a toner is used for a two component developer while a cyclic operation of consumption and replenishment of the toner is frequently performed, the particle diameter of the toner particles in the two component developer hardly changes, and thereby stable development can be performed (i.e., good images can be stubble produced) for a long period of time even if the toner is agitated in the developing device.

In addition, when the toner is used as a one component developer, the toner does not cause problems such that a toner film is formed on the developing roller used and the toner adheres to a member such as blades configured to regulate the toner to form a thin toner layer. Therefore, even when the toner is used for a long period of time in a developing device while agitated, stably development can be performed and good images can be stably produced.

In general, the smaller a particle diameter a toner has, the better the image qualities of the resultant toner images. However, the smaller particle diameter a toner has, the worse transferability and cleaning property the toner has. When the toner has a volume average particle diameter less than 3 μm, the toner tends to adhere to the surface of the carrier included in a two component developer if the developer is agitated for a long period of time, resulting in deterioration of the charging ability of the carrier. When such a small toner is used as a one component developer, the toner tends to cause problems such that a toner film is formed on the developing roller used and the toner adheres to a member such as blades configured to regulate the toner to form a thin toner layer. The same is true for the case in which the toner includes a large amount of fine toner particles.

In contrast, when the volume average particle diameter of the toner is greater than 7 μm, it is hard to produce high resolution and high quality images and in addition the particle diameter of the toner largely changes if a cyclic operation of consumption and replenishment is repeatedly performed. The same is true for the case in which the ratio Dv/Dn is greater than 1.25.

It is preferable that the ratio Dv/Dn approaches 1.00, because the resultant toner particles have uniform performance and the charge quantity thereof is uniform, and thereby high quality images can be stably produced. In addition, there is preferred stabilization of behavior of toner and uniformity of electrostatic charge amount when a volume average particle/number average particle is smaller than 1.03. However, it became clear that there was a point where the electrostatic charge of the toner was not enough and was found and to deteriorate cleaning property.

The toner of the present invention preferably has a controlled spherical degree and spherical degree distribution. When the toner has an average spherical degree less than 0.94, i.e., the toner has a form largely different from a spherical form, and high quality images cannot be produced (for example, transferability deteriorates and the resultant images have background fogging).

In the present invention, the spherical degree of the toner is preferably measured as follows:

the particles are optically observed by a CCD camera to analyze the shapes thereof, and the spherical degree of a particle is determined by the following equation:

$$\text{spherical degree}=Cs/Cp$$

wherein Cp represents the length of the circumference of the projected image of a particle and Cs represents the length of the circumference of a circle having the same area as that of the projected image of the particle. When the average spherical degree is from 0.94 to 0.99, the resultant toner can stably produce high quality images having a proper image density and a high resolution.

It is more preferable for the toner of the present invention to have an average spherical degree of from 0.975 to 0.990. In addition, in the toner of the present invention the content of the toner particles having a spherical degree less than 0.94 is preferably not greater-than 10%. In the present invention, the spherical degree and average spherical degree are measured by a flow-type particle image analyzer FPIA-2100 manufactured by Toa Medical Electronics Co., Ltd.

Modified Polyester Resin Reactive with Active Hydrogen

Suitable reactive modified polyester resins (RMPE) for use in the toner of the present-invention, which can react with an active hydrogen, include polyester prepolymers having a functional group, which can react with an active hydrogen, such as an isocyanate group. Suitable polyester prepolymers for use in the toner of the present invention include polyester prepolymer (A) having an isocyanate group.

The polyester prepolymer (A) having an isocyanate group can be prepared by reacting an isocyanate compound (PIC) with a polyester which is a polycondensation product of a polyol (PO) and a polycarboxylic acid (PC) and which has a group having an active hydrogen. Suitable groups having an active hydrogen include a hydroxyl group (an alcoholic hydroxyl group and a phenolic hydroxyl group), an amino group, a carboxyl group, a mercapto group, etc. Among these groups, the alcoholic hydroxyl group is preferable.

Suitable polyols (1) include diols (1-1) and polyols (1-2) having three or more hydroxyl groups. It is preferable to use a (1-1) alone or mixtures in which a small amount of a (1-2) is mixed with a (1-2).

Specific examples of the diols (1-1) include alkylene glycol
(e.g., ethylene glycol,
1,2-propylene glycol,
1,3-propylene glycol,
1,4-butanediol and
1,6-hexanediol);

alkylene ether glycols
(e.g., diethylene glycol,
triethylene glycol,
dipropylene glycol,
polyethylene glycol,
polypropylene glycol and
polytetramethylene ether glycol;

alicyclic diols
(e.g., 1,4-cyclohexane dimethanol and hydrogenated bisphenol A); bisphenols
(e.g., bisphenol A, bisphenol F and bisphenol S); adducts of the alicyclic diols mentioned above with an alkylene oxide
(e.g., ethylene oxide, propylene oxide and butylene oxide); adducts of the bisphenols mentioned above with an alkylene oxide
(e.g., ethylene oxide, propylene oxide and butylene oxide); etc.

Among these compounds, alkylene glycols having from 2 to 12 carbon atoms and adducts of a bisphenol with an alkylene oxide are preferable.

More preferably, adducts of a bisphenol with an alkylene oxide, or mixtures of an adduct of a bisphenol with an alkylene oxide and an alkylene glycol having from 2 to 12 carbon atoms are used.

Specific examples of the polyols (1-2) include aliphatic alcohols having three or more hydroxyl groups
(e.g., glycerin,
trimethylol ethane,
trimethylol propane,
pentaerythritol and
sorbitol);

polyphenols having three or more hydroxyl groups
(trisphenol PA,
phenol novolak and
cresol novolak);
adducts of the polyphenols mentioned above with an alkylene oxide; etc.

Suitable polycarboxylic acids (2) include dicarboxylic acids (2-1) and polycarboxylic acids (2-2) having three or more carboxyl groups. It is preferable to use dicarboxylic acids (2-1) alone or mixtures in which a small amount of a (2-2) is mixed with a (2-1). Specific examples of the dicarboxylic acids (2-1) include alkylene dicarboxylic acids
(e.g., succinic acid,
adipic acid and sebacic acid);

alkenylene dicarboxylic acids
(e.g., maleic acid and fumaric acid);

aromatic dicarboxylic acids
(e.g., phthalic acid, isophthalic acid,
terephthalic acid and
naphthalene dicarboxylic acids; etc.

Among these compounds, alkenylene dicarboxylic acids having from 4 to 20 carbon atoms and aromatic dicarboxylic acids having from 8 to 20 carbon atoms are preferably used.

Specific examples of the polycarboxylic acids (2-2) having three or more hydroxyl groups include aromatic polycarboxylic acids having from 9 to 20 carbon atoms (e.g., trimellitic acid and pyromellitic acid).

As the polycarboxylic acid (2), anhydrides or lower alkyl esters (e.g., methyl esters, ethyl esters or isopropyl esters) of the polycarboxylic acids mentioned above can be used for the reaction with a polyol(1).

preferred mixing ratios (i.e., an equivalence ratio [OH]/[COOH]) of a polyol (1) to a polycarboxylic acid (2) is from 2/1 to 1/1, more preferably from 1.5/1 to 1/1 and even more preferably from 1.3/1 to 1.02/1.

Specific examples of useful polyisocyanates (3) include aliphatic polyisocyanates
(e.g., tetramethylene diisocyanate,
hexamethylene diisocyanate and
2,6-diisocyanate methylcaproate);

alicyclic polyisocyanates
(e.g., isophorone diisocyanate and cyclohexylmethane diisocyanate); aromatic didicosycantes
(e.g., tolylene diisocyanate and diphenylmethane diisocyanate); aromatic aliphatic diisocyanates
(e.g., α, α, α', α'-tetramethyl xylylene diisocyanate); isocyanurates;
blocked polyisocyanates in which the polyisocyanates mentioned above are blocked with phenol derivatives,
oximes or caprolactams; etc.

These compounds can be used alone or in combination.

Preferred mixing ratios (i.e., [NCO]/[OH]) of a polyisocyanate (3) to a polyester having a hydroxyl group is from 5/1 to 1/1, more preferably from 4/1 to 1.2/1 and even more preferably from 2.5/1 to 1.5/1.

When the [NCO]/[OH] ratio is too large, the low temperature fixability of the toner deteriorates. In contrast, when the ratio is too small, the content of the urea group in the modified polyesters decreases and thereby the hot offset resistance of the toner deteriorates. The content of the constitutional component of a polyisocyanate (3) in the polyester prepolymer (A) having a polyisocyanate group at its end portion is from 0.5% to 40% by weight, preferably from 1% to 30% by weight and more preferably from 2% to 20% by weight.

When the content is too low, the hot offset resistance of the toner deteriorates and in addition the heat resistance and low temperature fixability of the toner also deteriorate. In contrast, when the content is too high, the low temperature fixability of the toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is too small (less than 1 per 1 molecule), the molecular weight of the resultant modified polyester decreases and thereby the hot offset resistance deteriorates.

The reactive modified polyester resins may be reacted with a crosslinking agent and/or an elongation agent.

As the crosslinking agent and elongation agent, amines including an amino group are preferably used.

Specific examples of the amines (B) include diamines (B1) polyamines (B2) having three or more amino groups, amino alcohols (B3), amino mercaptans (B4), amino acids (B5) and blocked amines (B6) in which the amines (B1–B5) mentioned above are blocked.

Specific examples of the diamines (B1) include aromatic diamines
(e.g., phenylene diamine,
diethyltoluene diamine and
4,4'-diaminodiphenyl methane);

alicyclic diamines
(e.g., 4,4'-diamino-3,3'-dimethyldicyclohexy-1 methane,
diaminocyclohexane and
isophoron diamine);

aliphatic diamines
(e.g., ethylene diamine,
tetramethylene diamine and
hexamethylene diamine); etc.

Specific examples of the polyamines (B2) having three or more amino groups include
diethylene triamine,
triethylene tetramine.

Specific examples of the amino alcohols (B3) include
ethanol amine and
hydroxyethyl aniline.

Specific examples of the amino mercaptan (B4) include
aminoethyl mercaptan and
aminopropyl mercaptan.

Specific examples of the amino acids (B5) include
amino propionic acid and
amino caproic acid.

Specific examples of the blocked amines (B6) include
ketimine compounds which are prepared by reacting one of the amines B1–B5 mentioned above with a ketone such as acetone, methyl ethyl ketone and methyl isobutyl ketone;
oxazoline compounds, etc.

Among these compounds, diamines (B1) and mixtures in which a diamine (B1) is mixed with a small amount of a polyamine (B2) are preferable.

The molecular weight of the modified polyesters can be controlled using an elongation anticatalyst, if desired.

Specific examples of the elongation anticatalyst include
monoamines
(e.g., diethyle amine,
dibutyl amine,
butyl amine and
lauryl amine),
and blocked amines
(i.e., ketimine compounds)
prepared by blocking the monoamines mentioned above.

The mixing ratio (i.e., a ratio [NCO]/[NHx]) of the prepolymer (A) having an isocyanate group to the amine (B) is preferably from 1/2 to 2/1, more preferably from 1.5/1 to 1/1.5 and even more preferably from 1.2/1 to 1/1.2. When the mixing ratio is too low or too high, the molecular weight of the resultant urea-modified polyester decreases, resulting in deterioration of the hot offset resistance of the resultant toner.

In the toner of the present invention, the modified polyester resins (A) can be used alone or in combination with unmodified polyester resins (C) as the binder resin of the toner. By using a combination of a modified polyester resin (A) with an unmodified polyester resin (C), the low temperature fixability of the toner can be improved and in addition the toner can produce color images having a high gloss.

Suitable unmodified polyester resins (C) include polycondensation products of a polyol with a polycarboxylic acid. Specific examples of the polyol and polycarboxylic acid are mentioned above for use in the modified polyester resins. In addition, specific examples of the suitable polyol(1) and polycarboxylic acid(2) are also mentioned above. In addition, as the unmodified polyester resins, polyester resins modified by a bonding (such as urethane bonding) other than a urea bonding, can also be used as well as the unmodified polyester resins mentioned above.

When a mixture of a modified polyester resin (A) with an unmodified polyester resin (C) is used as the binder resin, it is preferable that the modified polyester resin (A) at least partially mixes with the unmodified polyester resin (C) to improve the low temperature fixability and hot offset resistance of the toner. Namely, it is preferable that the modified polyester resin (A) has a structure similar to that of the unmodified polyester resin (C). The mixing ratio (A/C) of a modified polyester resin (A) to an unmodified polyester resin (C) is preferably from 5/95 to 75/25, more preferably from 10/90 to 25/85, even more preferably from 12/88 to 25/75, and most preferably from 12/88 to 22/78. When the addition amount of the modified polyester resin (A) is too small, the hot offset resistance of the toner deteriorates and in addition, it is impossible to achieve a good combination of high temperature preservability and low temperature fixability.

The peak molecular weight of the unmodified polyester resins (A) is preferably from 1,000 to 30,000, more preferably from 1,500 to 10,000 and most preferably from 2,000 to 8,000. When the peak molecular weight is too low, the heat resistance decreases. When the peak molecular weight is too high, low-temperature fixing property decreases.

In the present invention, the binder resin preferably has a glass transition temperature (Tg) of from 50° C. to 70° C., and preferably from 55° C. to 65° C.

When the glass transition temperature is too low, the high temperature preservability of the toner deteriorates. In contrast, when the glass transition temperature is too high, the low temperature fixability deteriorates.

When a cured and/or elongated polyester resin is used in combination with an unmodified polyester resin as the binder resin, the resultant toner has better high temperature preservability than conventional toners including a polyester resin as a binder resin even if the urea-modified polyester resin has a relatively low glass transition temperature compared to the polyester resin included in conventional toners.

With respect to the storage modulus of the toner binder for use in the toner of the present invention, the temperature (TG') at which the storage modulus is 10,000 dyne/cm$^2$ when measured at a frequency of 20 Hz is not lower than 100° C., and preferably from 110° C. to 200° C.

With respect to the viscosity of the toner binder, the temperature (Tη) at which the viscosity is 1,000 poise when measured at a frequency of 20 Hz is not higher than 180° C., and preferably from 90° C. to 160° C. When the temperature (Tη) is too high, the low temperature fixability of the toner deteriorates. In order to achieve a good combination of low temperature fixability and hot offset resistance, it is preferable that the TG' is higher than the Tη. Specifically, the difference (TG'−Tη) is preferably not less than 0° C., preferably not less than 10° C. and more preferably not less than 20° C. The difference particularly has an upper limit. In order to achieve a good combination of high temperature preservability and low temperature fixability, the difference (TG'−Tη) is preferably from 0° C. to 100° C., more preferably from 10° C. to 90° C. and even more preferably from 20° C. to 80° C.

The flow beginning temperature Tfb of the toner for electrostatic image development is preferably 80° C. to 170° C.

In the present invention, to provide toner particles of good charging ability and uniform particle distribution, toner formation using minute particles dispersed in an aqueous solvent may be used. Ther minute particle may be slightly soluble in the aqueous medium. Preferably, the average particle diameter of the minute particles has range of from 0.01 μm to 1 μm.

Specific examples of such inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, hydroxyapatite (preferably made by reacting sodium phosphate and calcium chloride), etc. In addition, crystallites of low molecular organic chemicals may be used as fine particles of organic substance.

Preferably, the size of the minute particle (Rs)/the size of toner particle(R) satisfies $5 \leqq R/Rs \leqq 2000$. It is more preferable that $20 \leqq R/Rs \leqq 200$. When these relations are not satisfied, particle control decreases.

In addition, the amount of an anchoring minute particle on the particle surface has range of from 0.1 wt % to 20 wt % by weight of resin particles. More preferably, form 1 wt % to 10 wt % by weight of resin particles.

From the view point of particle size control, the resin minute particle diameter preferably satisfies $5 \leqq Dv \leqq 500$, more preferably satisfies $50 \leqq Dv \leqq 200$. (volume average particle diameter: Dv [nm]) Preferably, particle size distribution has a Dv/Dn of resin fine particle smaller than 1.25. For particle size control, particles having a narrow distribution of particle size are preferable.

A resin fine particle may be provided by means of soap-free emulsified polymerization, suspension polymerization, dispersion polymerization, etc. Thermosetting resins and thermoplastic resins are preferable. Specific examples of the resins for use as resin particles include vinyl resin, polyurethane resin, epoxide resin, polyester resin, polyamide resin, polyimide resin, silicon type resin, phenol resin, melamine resin, urea resin, aniline resin, ionomer resin, polycarbonate resin, silicone resin, benzguanamine resin, and nylon resin. These resins are used alone or in combination. Of these, vinyl resin, polyurethane resin, epoxide resin, polyester resin and combinations thereof are desirable. Preferred are vinyl resin, polystyrene, methacrylate or acrylate. In addition, in terms of emulsification property, it is preferable to use surfactant having radical polymerization property as reaction initiator. The glass transition point (Tg) of the resin particle preferably is from 40 to 100° C., and the weight average molecular weight thereof preferably is 9,000 to 200,000.

When the glass transition point of the resin is too low, the preservability of the toner deteriorates. In contrast, when the glass transition point is too high, the stability of the toner worsens.

It is preferable for the residue rate in the toner particle to be controlled in range from 0.5 wt % to 5.0 wt %. When residue rate in the toner particle is less than 0.5 wt %, the toner decrease preservative property, therefore toner blocking occurs in safekeeping and developing machine.

In addition, when residue rate in the toner particle is more than 5.0 wt %, resin minute particle obstructs sweating of wax and the effect of releasability of wax is not provided, and printing offset occurs.

The residue rate in the resin minute particle is analyzed with thermal decomposition gas chromatograph mass spectrometer. The material which residue rate of resin minute particle is due to not toner particle, and it is due to the resin fine particle. The residue rate in the toner particle is calculated from the peak area of the analyzed result.

Mass spectrometer is preferable as detecting element. However, there is no limit in particular.

In the present invention toner, a content of THF soluble resin in the toner, which has molecular weight peak of from 1,000 to 30,000, is preferably from 1% by weight or more. And, a number average molecular weight range is 2,000 to 15,000. Such a condition is believed to make the low-temperature fixability and the offset resistance property compatible. The reason why content of high molecular weight component is comparatively small amount preferable modified group in modified polyester (portion of bonding group except for ester bond) has strong cohesion of hydrogen bond. By cohesion of modified group, the resin characteristic that cannot control can be controlled with molecular weight or degree of cross-linking.

A content of the THF soluble resin having a molecular weight of from 2,500 to 10,000 is preferably from 0.1 to 5.0% by weight. In addition, the molecular weight distribution of THF soluble component of any polyester type resin contained in the toner is such that from 0.1 to 5.0 wt % has a molecular weight less than 1000.

When said component is more than 5.0 wt %, it is unfavorable for pair offset property.

When said component is less than 0.1 wt %, it is increasing of raw materials and problem of manufacturing process, cost becomes high. Generally, THF insoluble components of the polyester type contained in toner is preferably in the range from 1 to 15% by weight.

When an aqueous dispersion or emulsion is prepared, a solvent which can dissolve the toner composition is preferably used because the resultant particles have a sharp particle diameter distribution. The solvent is preferably volatile and has a boiling point lower than 150° C. due to ease in being removed from the dispersion after the particles are formed.

Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used.

The addition quantity of such a solvent may be, for example, from 40 to 300 parts by weight, preferably from 60 to 140, and more preferably from 80 to 120 parts by weight, per 100 parts by weight of the toner composition used.

Suitable colorants for use in the toner of the present invention include known dyes and pigments. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobaltblue, ceruleanblue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1% to 15% by weight, and more preferably from 3% to 10% by weight, based on total weight of the toner.

Master batch pigments, which are prepared by combining a colorant with a resin, can be used as the colorant of the toner composition of the present invention. Specific examples of the resins for use in the master batch pigments or for use in combination with master batch pigments include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl.alpha.-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batch for use in the toner of the present invention is typically prepared by mixing and kneading a resin and a colorant upon application of high shear stress thereto. In this case, an organic solvent can be used to heighten the interaction of the colorant with the resin. In addition, flushing methods in which an aqueous paste including a colorant is mixed with a resin solution of an organic solvent to transfer the colorant to the resin solution and then the aqueous liquid and organic solvent are separated to be removed can be preferably used because the resultant wet cake of the colorant can be used as it is. In this case, three-roll mills can be preferably used for kneading the mixture upon application of high shear stress thereto.

A release agent may be included in the toner of the present invention. Suitable release agents include known waxes.

Specific examples of the release agent include polyolefin waxes such as polyethylene waxes and polypropylene waxes; long chain hydrocarbons such as paraffin waxes and SAZOL waxes; waxes including a carbonyl group, etc. Among these waxes, the waxes including a carbonyl group are preferably used.

Specific examples of the waxes including a carbonyl group include polyalkane acid esters such as carnauba wax, montan waxes, trimethylolpropane tribehenate, pentaerythritol tetrabehenate, pentaerythritol diacetate dibehenate, glycerin tribehenate, and 1,18-octadecanediol distearate; polyalkanol esters such as trimellitic acid tristearyl, and distearyl maleate; polyalkylamide such as trimellitic acid tristearylamide; dialkyl ketone such as distearyl ketone, etc. Among these materials, polyalkane acid esters are preferable.

The waxes for use in the toner of the present invention preferably have a melting point of from 40° C. to 160° C., more preferably from 50° C. to 120° C., and even more preferably from 60° C. to 90° C. When the melting point of the wax included in the toner is too low, the high temperature preservability of the toner deteriorates. In contrast, when the melting point is too high, a cold offset problem in that an offset phenomenon occurs at a low fixing temperature tends to occur.

The wax used in the toner of the present invention preferably has a melt viscosity of from 5 to 1000 cps and more preferably from 10 to 100 cps at a temperature 20° C. higher than the melting point of the wax. When the melt viscosity is too high, the effect of improving the hot offset resistance and low temperature fixability is lessened. The content of the wax in the toner is from 0% to 40% by weight and preferably from 3% to 30% by weight based on total weight of the toner.

A charge controlling agent may be included in the toner of the present invention.

Specific examples of the charge controlling agent include known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc.

Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid) E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images.

The charge controlling agent can be dissolved or dispersed in an organic solvent after kneaded together with a master batch pigment and resin. In addition, the charge controlling agent can be directly dissolved or dispersed in an organic solvent when the toner constituents are dissolved or dispersed in an organic solvent. Alternatively, the charge controlling agent may be fixed on the surface of the toner particles after the toner particles are prepared.

Preferably, the charge controlling resin particle, for example polymer type particle is produced by soap-free emulsified polymerization, suspension polymerization, dispersion polymerization. Especially, polycondensation system of silicone, benzoguanamine or nylon, polystyrene provide by monomer which polymer fine particle by thermosetting resin which copolymer was able to put polystyrene turned monomer and copolymerization having carboxyl group of methacrylic acid in particular into, fluorine type methacrylate and fluorine type acrylate in case of emulsion polymerization, dispersion polymerization are made.

The thus prepared toner particles may be mixed with an external additive to assist in improving the fluidity, developing property and charging ability of the toner particles. Suitable external additives include particulate inorganic materials. It is preferable for the particulate inorganic materials to have a primary particle diameter of from 5 mμ to 2 μm, and more preferably from 5 mμ to 500 mμ. In addition, it is preferable that the specific surface area of such particulate inorganic materials measured by a BET method is from 20 $m^2/g$ to 500 $m^2/g$. The content of the external additive is preferably from 0.01% to 5% by weight, and more preferably from 0.01% to 2.0% by weight, based on total weight of the toner.

Specific examples of such inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

In addition, particles of polymers such as polymers and copolymers of styrene, methacrylates, acrylates or the like; polymers prepared by polycondensation polymerization, such as silicone resins, benzoguanamine resins and nylon resins; and thermosetting resins, which can be prepared by a soap-free emulsion polymerization method, a suspension polymerization method or a dispersion method, can also be used as the external additive.

These materials for use as the external additive can be subjected to a surface treatment to be hydrophobized, thereby preventing the fluidity and charge properties of the toner even under high humidity conditions. Specific examples of the hydrophobizing agents include silane coupling agents, silylation agents, silane coupling agents including a fluoroalkyl group, organic titanate coupling agents, aluminum coupling agents, silicone oils, modified silicone oils, etc.

The toner of the present invention may include a cleanability improving agent to improve the cleaning ability thereof such that the toner remaining on an image bearing member such as photoreceptors and intermediate transfer belts can be easily removed therefrom. Specific examples of the cleanability improving agents include fatty acids and metal salts thereof such as zinc stearate, calcium stearate and stearic acid; polymer particles which are prepared by a soap-free emulsion polymerization method or the like, such as polymethyl methacrylate particles and polystyrene particles; etc. The polymer particles preferably have a narrow particle diameter distribution and the volume average particle diameter thereof is preferably from 0.01 μm to 1 μm.

The binder resins (e.g., modified polyester resins and unmodified polyester resins) for use in the toner of the present invention may typically be prepared by the following method.

A polyol and a polycarboxylic acid are heated to a temperature of from 150° C. to 280° C. in the presence of a known esterification catalyst such as tetrabutoxy titanate and dibutyltinoxide. Then water generated is removed, under a reduced pressure if desired, to prepare a polyester resin having a hydroxyl group. Then the polyester resin is reacted with a polyisocyanate at a temperature of from 40° C. to 140° C. to prepare a prepolymer (A) having an isocyanate group.

The toner of the present invention can be manufactured by the following method, but the manufacturing method is not limited thereto.

Suitable aqueous media for use in the toner manufacturing method of the present invention include water and mixtures of water with a solvent which can be mixed with water. Specific examples of such a solvent include alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc. In addition, there is when adding fine particle of resin fine particle in aqueous solvent phase beforehand.

Toner particles can be prepared by reacting a dispersion, in which a prepolymer (A) having an isocyanate group is dispersed in an aqueous medium, with an amine (B).

In order to prepare a dispersion in which a urea-modified polyester resin or a prepolymer (A) is stably dispersed in an aqueous medium, a method, in which toner constituents including a urea-modified polyester or a prepolymer (A) are added into an aqueous medium and then dispersed upon application of shear stress, is preferably used.

A prepolymer (A) and other toner constituents such as colorants, master batch pigments, release agents, charge controlling agents, unmodified polyester resins, etc. may be added into an aqueous medium at the same time when the dispersion is prepared. However, it is preferable that the toner constituents are previously mixed and then the mixed toner constituents are added to the aqueous liquid at the same time to be dispersed. In addition, toner constituents such as colorants, release agents and charge controlling agents are not necessarily added to the aqueous dispersion before particles are formed, and may be added thereto after particles are prepared in the aqueous medium. For example, a method in which particles, which are previously formed without a colorant, are dyed by a known dying method can also be used.

The dispersion method is not particularly limited, and low speed shearing methods, high speed shearing methods, friction methods, high pressure jet methods, ultrasonic methods, etc. can be used. Among these methods, high speed shearing methods are preferable because particles having a particle diameter of from 2 μm to 20 μm can be easily prepared.

When a high speed shearing type dispersion machine is used, the rotation speed is not particularly limited, but the rotation speed is typically from 1,000 rpm to 30,000 rpm, and preferably from 5,000 rpm to 20,000 rpm. The dispersion time is not also particularly limited, but is typically from 0.1 to 5 minutes. The temperature in the dispersion process is typically from 0° C. to 150° C. (under pressure), and preferably from 40° C. to 98° C. When the temperature is relatively high, a urea-modified polyester or a prepolymer (A) can be easily dispersed because the dispersion has a low viscosity.

The weight ratio (T/M) of the toner constituents (T) (including a prepolymer (A)) to the aqueous medium (M) is typically from 100/50 to 100/2,000, and preferably from 100/100 to 100/1,000. When the ratio is too large (i.e., the quantity of the aqueous medium is small), the dispersion of the toner constituents in the aqueous medium is not satisfactory, and thereby the resultant toner particles do not have a desired particle diameter. In contrast, when the ratio is too small, the manufacturing costs increase.

Specific examples of the dispersants which are used for dispersing or emulsifying an oil phase, in which toner constituents are dissolved or dispersed, in an aqueous liquid, include anionic surfactants such as alkylbenzene sulfonic acid salts, .alpha.-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi (aminoethyl)glycin, di)octylaminoethyle)glycin, and N-alkyl-N,N-dimethylammonium betaine.

By using a surfactant having a fluoroalkyl group, a dispersion having good dispersibility can be prepared even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylgl-utamate, sodium 3-{omega-fluoroalkanoyl (C6–C11)oxy}-1-alkyl(C3–C4) sulfonate, sodium 3-{omega-fluoroalkanoyl(C6–C8)-N-ethylamino}-1-propanes-ulfonate, fluoroalkyl(C11–C20) carboxylic acids and their metal salts, perfluoroalkylcarboxylic acids and their metal salts, perfluoroalkyl(C4–C12)sulfonate and their metal salts, perfluorooctanesulfonic acid diethanol amides, N-propyl-N-(2-hydroxyethyl-)perfluorooctanesulfone amide, perfluoroalkyl(C6–C10)sulfoneamidepropyltri-methylammonium salts, salts of perfluoroalkyl (C6–C10)-N-ethylsulfonyl glycin, monoperfluoroalkyl(C6–C16)ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNTDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A,306A, 501, 201 and 204, which are manufactured by Tohchem Products Co., Ltd.; FUTARGENT F-100 and F150 manufactured by Neos; etc.

Specific examples of the cationic surfactants, which can be used for dispersing an oil phase including toner constituents in water, include primary, secondary and tertiary aliphatic amines having a fluoroalkyl group, aliphatic quaternary ammonium salts such as perfluoroalkyl(C6–C10) sulfoneamidepropyltrimethylammonium salts, benzalkonium salts, benzetonium chloride, pyridinium salts, imidazolinium salts, etc. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

An inorganic compound which is hardly soluble in water, such as calcium phosphate, titanium oxide, colloidal silica, and hydroxyapatite can also be used as the dispersant.

Further, it is possible to stably disperse toner constituents in water using a polymeric protection colloid. Specific examples of such protection colloids include polymers and copolymers prepared using monomers such as acids (e.g., acrylic acid, methacrylic acid, .alpha.-cyanoacrylic acid, .alpha.-cyanomethacrylic acid, itaconic acid, crotonic acid, fumaric acid, maleic acid and maleic anhydride), acrylic monomers having a hydroxyl group (e.g., .beta.-hydroxyethyl acrylate, .beta.-hydroxypropyl methacrylate, .beta.-hydroxypropyl acrylate, .beta.-hydroxypropyl methacrylate, .gamma.-hydroxypropyl acrylate, .gamma.-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds; acid chlorides (e.g., acrylic acid chloride and methacrylic acid chloride); and monomers having a nitrogen atom or an alicyclic ring having a nitrogen atom (e.g., vinyl pyridine, vinyl pyrrolidone, vinyl imidazole and ethylene imine).

Polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When compounds such as calcium phosphate which are soluble in an acid or alkali are used as a dispersion stabilizer, it is preferable to dissolve calcium phosphate by adding an acid such as hydrochloric acid and to wash the resultant particles with water to remove calcium phosphate therefrom. In addition, such a dispersion stabilizer can be removed using a decomposition method using an enzyme.

When a dispersant is used, the resultant particles are preferably washed after the particles are subjected to an elongation and/or a crosslinking reaction to impart good charge ability to the resultant toner particles.

When a modified polyester resin reactive with an active hydrogen is reacted with an amine (B) serving as a crosslinking agent and/or an elongation agent, the crosslinking time and/or the elongation time is determined depending on the reactivity of the isocyanate group of the prepolymer (A) with the amine (B) used, but in general the time is from 10 minutes to 40 hours, and preferably from 2 to 24 hours. The reaction temperature is generally from 0° C. to 150° C., and preferably from 40° C. to 98° C. In addition, a catalyst such as dibutyltin laurate and dioctyltin laurate can be optionally used for the reaction.

In order to remove the organic solvent from the thus prepared emulsion (dispersion), a drying method in which the temperature of the emulsion is gradually increased to evaporate the organic solvent from the drops dispersed in the emulsion can be used. Alternatively, a drying method in which the emulsion is sprayed in a dry atmosphere to dry not only the organic solvent in the drops in the emulsion but also the remaining aqueous medium. The dry atmosphere can be prepared by heating gases such as air, nitrogen, carbon dioxide and combustion gases. The temperature of the heated gases is preferably higher than the boiling point of the solvent having the highest boiling point among the solvents used in the emulsion. By using spray dryers, belt dryers, rotary kilns, etc., as a drying apparatus, the drying treatment can be completed in a short period of time.

When particle size distribution in emulsification dispersion keeps the particle size distribution broadly, and cleaning and desiccation treatment did, classifying is done, and desired particle size distribution can fix particle size distribution.

When the thus prepared toner particles have a wide particle diameter distribution even after the particles are subjected to a washing treatment and a drying treatment, the toner particles are preferably subjected to a classification treatment so that the toner particles have a desired particle diameter distribution. The classification operation can be performed on a dispersion liquid using a cyclone, a decanter or a method utilizing centrifuge to remove fine particles therefrom. Of course, it is possible to classify the dried toner particles. However, it is preferable to subject the liquid including the particles to the classification treatment in view of efficiency. The toner particles having an undesired particle diameter can be reused as the raw materials for the kneading process. Such toner particles for reuse may be in a dry condition or a wet condition.

The dispersant used is preferably removed from the particle dispersion. The dispersant is preferably removed from the dispersion when the classification treatment is performed.

The thus prepared toner particles can be mixed with other particles such as release agents, charge controlling agents, fluidizing agents and colorants. Such particles can be fixed on the toner particles by applying mechanical impact thereto while the particles and toner particle can be integrated. Thus the particles can be prevented from being released from the toner particles.

Specific examples of such mechanical impact application methods include methods in which a mixture is mixed with a highly rotated blade and methods in which a mixture is put into a jet air to collide the particles against each other or a collision plate.

Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

The toner of the present invention can be used for a two-component developer in which the toner is mixed with a magnetic carrier. The weight ratio (T/C) of the toner (T) to the carrier (C) is preferably from 1/100 to 10/100.

Suitable carriers for use in the two component developer include known carrier materials such as iron powders, ferrite powders, magnetite powders, magnetic resin carriers, which have a particle diameter of from about 20 μm to about 200 μm. The surface of the carriers may be coated by a resin.

Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

If desired, an electroconductive powder may be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner. The toner of the present invention can also be used as a one-component magnetic developer or a one-component non-magnetic developer.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Synthesis of Low Molecular Weight Polyester

Manufacturing Example 1-1

In a reaction container equipped with a condenser, a stirrer and a pipe from which a nitrogen gas was supplied to the container, 229 parts of an adduct of bisphenol A with 2 moles of ethyleneoxide, 529 parts of an adduct of bisphenol A with 3 moles of propyleneoxide, 208 parts of terephthalic acid, 46 parts of adipic acid, and 2 parts of dibutyl tin oxide were mixed. Then the mixture was reacted for 8 hours at 230° C. under a normal pressure. Then the reaction was further performed for 5 hours under a reduced pressure of from 10 mmHg to 15 mmHg. In addition, 44 parts of trimellitic anhydride were added thereto and the mixture was reacted for 2 hours at 180° C. under a normal pressure. Thus, a low molecular weight polyester 1 was prepared. The low molecular weight polyester 1 had a number average molecular weight of 2500, a weight average molecular weight of 6700, a glass transition temperature of 43° C. and an acid value of 25.

Preparation of Prepolymer

Manufacturing Example 2

In a reaction container equipped with a condenser, a stirrer and a pipe from which a nitrogen gas was supplied to the container, 682 parts of an adduct of bisphenol A with 2 moles of ethyleneoxide, 81 parts of an adduct of bisphenol A with 2 moles of propyleneoxide, 283 parts of terephthalic acid, 22 parts of trimellitic anhydride, and 2 parts of dibutyl tin oxide were mixed. Then the mixture was reacted for 8 hours at 230° C. under a normal pressure. Then the reaction was further performed for 5 hours under a reduced pressure of from 10 to 15 mmHg. Thus, an intermediate polyester 1 was prepared. The intermediate polyester 1 had a number average molecular weight of 2100, a weight average molecular weight of 9500, a glass transition temperature of 55° C. acid value of 0.5 and a hydroxyl value of 51.

In a reaction container equipped with a condenser, a stirrer and a pipe from which a nitrogen gas was supplied to the container, 411 parts of the intermediate polyester 1, 89 parts of isophorondiisocyanate and 500 parts of ethyl acetate were added. The mixture was reacted for 5 hours at 100° C. Thus, a prepolymer 1 was prepared. The prepolymer included a free isocyanate group in an amount of 1.53% by weight. The solid content of the prepolymer was 50% when measured by heating the dispersion at 130° C. for 30 minutes.

Synthesis of Ketimine

Manufacturing Example 3

In a reaction container equipped with a stirrer and a thermometer, 170 parts of isophoronediamine and 75 parts of methyl ethyl ketone were mixed. The mixture was reacted for 5 hours at 50° C. Thus, a ketimine compound 1 was prepared. The ketimine compound had an amine value of 418.

(Preparation of MB)

Manufacturing Example 4-1

1200 parts of water, 800 parts of carbon black, and 800 parts of polyester resin were mixed in a Henshel mixer (made in MITSUI MINING COMPANY, LTD.).

This mixture was kneaded for 30 minutes at 130° C. using a two-roll mill.

After rolling cooled, the kneaded mixture was pulverized. Thus, a[master batch 1] was prepared.

Manufacturing Example 4-2

1200 parts of water, 800 parts of C.I. Pigment yellow 180, and 800 parts of polyester resin were mixed in a Henshel mixer (made in MITSUI MINING COMPANY, LTD.).

This mixture was kneaded for 30 minutes at 150° C. using a two-roll mill.

After the mixture was rolling and cooled, the kneaded mixture was pulverized. Thus, a[master batch 2] was prepared.

Manufacturing Example 4-3

1200 parts of water, 3800 parts of Cu-phthalocyanine 5, and 800 parts of polyester resin were mixed in a Henshel mixer.

This mixture was kneaded for 30 minutes at 150° C. using a two-roll mill.

After the mixture was rolling and cooled, the kneaded mixture was pulverized. Thus, a[master batch 3] was prepared.

Manufacturing Example 4-4

1200 parts of water, 800 parts of C.I. Pigment red 122, and 800 parts of polyester resin were mixed in a Henshel mixer.

This mixture was kneaded for 30 minutes at 150° C. using a two-roll mill.

After the mixture was rolling and cooled, the kneaded mixture was pulverized. Thus, a[master batch 4] was prepared.

Preparation of Oil Phase

Manufacturing Example 5-1

In a reaction container equipped with a stirrer and a thermometer, 100 parts of synthetic ester wax low molecular weight polyester 1, 20 parts of a metal complex of salicylic acid serving as a charge controlling agent (E-84 from Orient Chemical Industries Co., Ltd.) and 880 parts of ethyl acetate were mixed. The mixture was heated at 80° C. for 5 hours while agitated and then cooled to 30° C. while taking one hour. Then 400 parts of the master batch 1 and 600 parts of ethyl acetate were added thereto to be mixed for 1 hour. Thus, a toner constituent solution 1 was prepared.

Then 600 parts of the toner constituent solution 1 were contained in a container, and then dispersed using a bead mill (ULTRAVISCOMILL from AIMEX) under the following conditions:

Liquid feeding speed: 1 kg/hr,

Disc rotation speed: 6 m/sec,

Diameter of beads: 0.5 mm,

Filling factor: 80% by volume, and

Repeat number of dispersion treatment: 3 times.

Thus, the pigment and wax were dispersed. Then 2024 parts of a 65% ethyl acetate solution of the low molecular weight polyester 1 were added thereto, and the mixture was dispersed under the conditions mentioned above except that the repeat number of the dispersion treatment was changed to 1 time. Thus, a pigment/wax dispersion 1 was prepared. The solid content of the pigment/wax dispersion 1 was 49% when measured by heating the dispersion at 130° C. for 30 minutes.

Manufacturing Example 5-2

The procedure for preparation of the pigment/wax dispersion 1 was repeated except that the master batch 1 was replaced with the master batch 2. Thus, pigment/wax dispersion 2 was prepared.

The solid content of the pigment/wax dispersion 2 was 50% when measured by heating the dispersion at 130° C. for 30 minutes.

Manufacturing Example 5-3

The procedure for preparation of the pigment/wax dispersion 1 was repeated except that the master batch 1 was replaced with the master batch 3. Thus, pigment/wax dispersion 3 was prepared.

The solid content of the pigment/wax dispersion 2 was 49% when measured by heating the dispersion at 130° C. for 30 minutes.

Manufacturing Example 5-4

The procedure for preparation of the pigment/wax dispersion 1 was repeated except that the master batch 1 was replaced with the master batch 4. Thus, pigment/wax dispersion 4 was prepared.

The solid content of the pigment/wax dispersion 4 was 50% when measured by heating the dispersion at 130° C. for 30 minutes.

Preparation of Aqueous Phase

Manufacturing Example 6-1

In a container, 990 parts of water, 80 parts of the particle dispersion 1, 35 parts of a 49.3% aqueous solution of sodium dodecyldiphenylether disulfonate (EREMINOR MON-7 manufactured by Sanyo Chemical Industries, Ltd.) and 90 parts of ethyl acetate were mixed. As a result, an aqueous phase 1 was prepared.

Preparation of Fluorine Type Activator Aqueous Solution

Manufacturing Example 7-1

In container, 10 parts of N,N,N-trimethly-[3-(4-perfluorononenyloxy banzamide)propyl]ammonium iodide(Ftergent 310 manufactured by Neos Company), 297 parts of methanol s were mixed.

The mixture was heated at 50° C. while agitated and the mixture become transparent.

Then the fluorine type activator methanol solution was provided.

693 parts of ion exchanged water agitating drop wised to the fluorine active agent methyl alcohol solution.

After a drop wise was finished, it was agitated in 50° C. for 30 minutes.

Fluorine active agent water solution 1 was thus prepared.

Emulsification and Solvent Removal

EXAMPLE 1

The following components were contained in a contained to be mixed for 1 minute using a TK HOMOMIXER (manufactured by Tokushu Kika Kogyo Co., Ltd.) at a revolution of 5,000 rpm.

| | |
|---|---|
| 1. Pigment/wax dispersion 1 | 806 parts |
| 2. Prepolymer 1 | 154 parts |
| 3. Ketimine compound | 10.7 parts |

Then, 1960 parts of the aqueous phase 1 were added thereto and the mixture was dispersed for 20 minute using a TK HOMOMIXER at a revolution of 13,000 rpm. Thus, an emulsion slurry 1 was prepared.

In a container equipped with a stirrer and a thermometer, the emulsion slurry 1 was added and then was heated at 30° C. for 8 hour to remove the solvents therefrom. Then the slurry was aged at 50° C. for 8 hours to prepare a dispersion slurry 1.

Washing and Drying 100 parts of the emulsion slurry 1 were filtered by filtering under a reduced pressure. Then the following operations were performed.

(1) 100 parts of deionized water were added to the thus prepared cake and the mixture was mixed for 10 minutes by a TK HOMOMIXER at a revolution of 12,000 rpm and then filtered;

(2) 100 parts of a 10% aqueous solution of sodium hydroxide were added to the cake prepared in (1) and the mixture was mixed for 30 minutes by a TK HOMOMIXER at a revolution of 12,000 rpm while applying supersonic vibration thereto, and then filtered under a reduced pressure, wherein this washing using an alkali was repeated twice;

(3) 100 parts of a 10% hydrochloric acid were added to the cake prepared in (2) and the mixture was mixed for 10 minutes by a TK HOMOMIXER at a revolution of 12,000 rpm and then filtered; and (4) 300 parts of deionized water were added to the cake prepared in (3) and the mixture was mixed for 10 minutes by a TK HOMOMIXER at a revolution of 12,000 rpm and then filtered; wherein this washing was repeated twice to prepare a filtered cake 1.

Fluorine Type Activator Treatment

In container, 630 parts of filtered cake 1, 2928 parts of ion-exchange water were agitated for 5 minutes by three one motor (manufactured by Shinto Science Corp.) at revolution of 4,000 rpm.

The mixture composition was heated for 30° C.

The fluorine active agent water solution 1 drop wised to the mixture composition under maintaining at revolution and temperature.

After drop wised, the mixture composition was agitated for 60 minutes, wherein this filtered to prepare a Fluorine type activator treatment filtered cake 1.

The filtered cake 1 was dried for 48 hours at 45° C. using a circulating drier. The dried cake was sieved using a screen having openings of 75 μm. Thus a toner 1 was prepared.

EXAMPLE 2

The procedure for preparation of the toner 1 was repeated except that the pigment/wax dispersion 1 was replaced with the pigment/wax dispersion 2. Thus, a toner 2 was prepared.

EXAMPLE 3

The procedure for preparation of the toner 1 was repeated except that the pigment/wax dispersion 1 was replaced with the pigment/wax dispersion 3. Thus, a toner 3 was prepared.

EXAMPLE 4

The procedure for preparation of the toner 1 was repeated except that the pigment/wax dispersion 1 was replaced with the pigment/wax dispersion 4. Thus, a toner 4 was prepared.

Then 600 parts of the toner constituent solution 1 were contained in a container, and then dispersed using a bead mill (ULTRAVISCOMILL from AIMEX) under the following conditions:

Liquid feeding speed: 1 kg/hr,
Disc rotation speed: 6 m/sec,
Diameter of beads: 0.5 mm,
Filling factor: 80% by volume, and
Repeat number of dispersion treatment: 3 to 12 times.

Thus, the pigment and wax were dispersed. Then 588 parts of a 65% ethyl acetate solution of the low molecular weight polyester 1 were added thereto, and the mixture was dispersed under the conditions mentioned above except that the repeat number of the dispersion treatment was changed to 1 time. Thus, a pigment/wax dispersion 1 was prepared. The solid content of the pigment/wax dispersion 1 was 50% when measured by heating the dispersion at 130° C. for 30 minutes.

Manufacturing Example 5-6

The procedure for preparation of the pigment/wax dispersion 1 was repeated except that the master batch 1 was replaced with the master batch 2. Thus, pigment/wax dispersion 6 was prepared.

The solid content of the pigment/wax dispersion 6 was 50% when measured by heating the dispersion at 130° C. for 30 minutes.

Manufacturing Example 5-7

The procedure for preparation of the pigment/wax dispersion 1 was repeated except that the master batch 1 was replaced with the master batch 3. Thus, pigment/wax dispersion 7 was prepared.

The solid content of the pigment/wax dispersion 7 was 50% when measured by heating the dispersion at 130° C. for 30 minutes.

Manufacturing Example 5-8

The procedure for preparation of the pigment/wax dispersion 1 was repeated except that the master batch 1 was replaced with the master batch 4. Thus, pigment/wax dispersion 8 was prepared.

The solid content of the pigment/wax dispersion 8 was 50% when measured by heating the dispersion at 130° C. for 30 minutes.

Emulsification and Solvent Removal

EXAMPLE 5

The following components were contained in a contained to be mixed for 1 minute using a TK HOMOMIXER at a revolution of 5,000 rpm.

| | |
|---|---|
| 1. Pigment/wax dispersion 5 | 888 parts |
| 2. Prepolymer 1 | 1464 parts |
| 3. Ketimine compound | 6.2 parts |

Then, 1960 parts of the aqueous phase 1 were added thereto and the mixture was dispersed for 20 minute using a TK HOMOMIXER at a revolution of 13,000 rpm. Thus, an emulsion slurry 2 was prepared.

In a container equipped with a stirrer and a thermometer, the emulsion slurry 2 was added and then was heated at 30° C. for 8 hour to remove the solvents therefrom. Then the slurry was aged at 50° C. for 8 hours to prepare a dispersion slurry 2.

Washing and Drying 100 parts of the emulsion slurry 1 were filtered by filtering under a reduced pressure. Then the following operations were performed.

(1) 100 parts of deionized water were added to the thus prepared cake and the mixture was mixed for 10 minutes by a TK HOMOMIXER at a revolution of 12,000 rpm and then filtered;

(2) 100 parts of a 10% aqueous solution of sodium hydroxide were added to the cake prepared in (1) and the mixture was mixed for 30 minutes by a TK HOMOMIXER at a revolution of 12,000 rpm while applying supersonic vibration thereto, and then filtered under a reduced pressure, wherein this washing using an alkali was repeated twice;

(3) 100 parts of a 10% hydrochloric acid were added to the cake prepared in (2) and the mixture was mixed for 10 minutes by a TK HOMOMIXER at a revolution of 12,000 rpm and then filtered; and (4) 300 parts of deionized water were added to the cake prepared in (3) and the mixture was mixed for 10 minutes by a TK HOMOMIXER at a revolution of 12,000 rpm and then filtered, wherein this washing was repeated twice to prepare a filtered cake 1.

Fluorine Type Activator Treatment

In container, 630 parts of filtered cake 2, 2928 parts of ion-exchange water were agitated for 5 minutes by three one motor (manufactured by Shinto Science Corp.) at revolution of 4,000rpm.

The mixture composition was heated for 30° C. The fluorine active agent water solution 1 drop wised to the mixture composition under maintaining at revolution and temperature. After drop wised, the mixture composition was agitated for 60 minutes, wherein this filtered to prepare a Fluorine type activator treatment filtered cake 2.

(Desiccation/Air Elutriation)

The filtered cake 2 was dried for 48 hours at 45° C. using a circulating drier. The dried cake was sieved using a screen having openings of 75 μm. Thus a toner 5 was prepared.

EXAMPLE 6

The procedure for preparation of the toner 6 was repeated except that the pigment/wax dispersion 5 was replaced with the pigment/wax dispersion 6. Thus, a toner 6 was prepared.

EXAMPLE 7

The procedure for preparation of the toner 7 was repeated except that the pigment/wax dispersion 5 was replaced with the pigment/wax dispersion 7. Thus, a toner 7 was prepared.

EXAMPLE 8

The procedure for preparation of the toner 8 was repeated except that the pigment/wax dispersion 5 was replaced with the pigment/wax dispersion 8. Thus, a toner 8 was prepared.

Synthesis of Emulsion of Resin Particles

Manufacturing Example 8-1

In a reaction container equipped with a stirrer and a thermometer, 683 parts of water, 11 parts of a sodium salt of sulfate of an adduct of methacrylic acid with ethyleneoxide (EREMINOR RS-30 from Sanyo Chemical Industries Ltd.), 83 parts of styrene, 83 parts of methacrylic acid, 111 parts of butyl acrylate, and 1 part of ammonium persulfate were added and the mixture was agitated for 15 minutes at a revolution of 400 rpm. As a result, a white emulsion was obtained. Then the emulsion was heated to 75° C. to perform a reaction for 5 hours. Then 30 parts of a 1% aqueous solution of ammonium persulfate were added to the emulsion and the mixture was further aged for 5 hours at 75° C. Thus, an aqueous dispersion (particle dispersion 1) of a vinyl resin (i.e., a copolymer of styrene-methacrylic acid-methacrylate-a sodium salt of a sulfate of an adduct of methacrylic acid with ethyleneoxide) was prepared. The volume average particle diameter of the particle dispersion 1 was 0.10 μm when measured with an instrument LA-920.

A part of the particle dispersion 1 was dried to prepare a particulate resin. The glass transition temperature of the particulate resin was 60° C.

Preparation of Aqueous Phase

Manufacturing Example 6-2

83 parts of the particle dispersion 1 were mixed with 990 parts of water, 40 parts of a 48.5% aqueous solution of sodium dodecyl diphenyl ether disulfonate (EREMINOR MON-7 from Sanyo Chemical Industries, Ltd.), and 90 parts of ethyl acetate. Thus, an aqueous phase 2 was prepared.

EXAMPLE 9

The procedure for preparation of the toner 9 was repeated except that the aqueous phase 1 was replaced with the aqueous phase 2. Thus, a toner 9 was prepared.

EXAMPLE 10

The procedure for preparation of the toner 10 was repeated except that the aqueous phase 1 was replaced with the aqueous phase 2. Thus, a toner 10 was prepared.

EXAMPLE 11

The procedure for preparation of the toner 11 was repeated except that the aqueous phase 1 was replaced with the aqueous phase 2. Thus, a toner 11 was prepared.

EXAMPLE 12

The procedure for preparation of the toner 12 was repeated except that the aqueous phase 1 was replaced with the aqueous phase 2. Thus, a toner 12 was prepared.

Emulsification and Solvent Removal

EXAMPLE 13

The following components were contained in a contained to be mixed for 1 minute using a TK HOMOMIXER (manufactured by Tokushu Kika Kogyo Co., Ltd.) at a revolution of 5,000 rpm.

| | |
|---|---|
| 1. Pigment/wax dispersion 1 | 888 parts |
| 2. Prepolymer 1 | 146 parts |
| 3. Ketimine compound | 6.2 parts |

Then, 1960 parts of the aqueous phase 2 were added thereto and the mixture was dispersed for 20 minute using a TK HOMOMIXER at a revolution of 13,000 rpm. Thus, an emulsion slurry 3 was prepared.

In a container equipped with a stirrer and a thermometer, the emulsion slurry 1 was added and then was heated at 30° C. for 8 hour to remove the solvents therefrom. Then the slurry was aged at 50° C. for 8 hours to prepare a dispersion slurry 3. Using a procedure as in example 5, a toner 13 was prepared.

Preparation of Fluorine Type Activator Aqueous Solution

Manufacturing Example 7-2

In container, 10 parts of MEGAFACE F-120 manufactured by DAINIPPON INK AND CHEMICALS INC.), 297 parts of methanol s were mixed.

The mixture was heated at 50° C. while agitated and the mixture become transparent.

Then the fluorine type activator methanol solution was provided.

693 parts of ion exchanged water agitating drop wised to the fluorine active agent methyl alcohol solution.

After a drop wise was finished, it was sagitated in 50° C. for 30 minutes.

That result fluorine active agent water solution 2 was prepared.

EXAMPLE 14

Washing and Drying 100 parts of the emulsion slurry 3 were filtered by filtering under a reduced pressure. Then the following operations were performed.

(1) 100 parts of deionized water were added to the thus prepared cake and the mixture was mixed for 10 minutes by a TK HOMOMIXER at a revolution of 12,000 rpm and then filtered;

(2) 100 parts of a 10% aqueous solution of sodium hydroxide were added to the cake prepared in (1) and the mixture was mixed for 30 minutes by a TK HOMOMIXER at a revolution of 12,000 rpm while applying supersonic vibration thereto, and then filtered under a reduced pressure, wherein this washing using an alkali was repeated twice;

(3) 100 parts of a 10% hydrochloric acid were added to the cake prepared in (2) and the mixture was mixed for 10 minutes by a TK HOMOMIXER at a revolution of 12,000 rpm and then filtered; and (4) 300 parts of deionized water were added to the cake prepared in (3) and the mixture was mixed for 10 minutes by a TK HOMOMIXER at a revolution of 12,000 rpm and then filtered, wherein this washing was repeated twice to prepare a filtered cake 2.

Fluorine Type Activator Treatment

In container, 630 parts of filtered cake 2, 2928 parts of ion-exchange water were agitated for 5 minutes by three one motor (manufactured by Shinto Science Corp.) at revolution of 4,000 rpm.

The mixture composition was heated for 30° C. The fluorine active agent water solution 1 drop wised to the mixture composition under maintaining at revolution and temperature. After drop wised, the mixture composition was agitated for 60 minutes, wherein this filtered to prepare a Fluorine type activator treatment filtered cake 3.

(Desiccation/Air Elutriation)

The fluorine type activator treatment filtered cake 3 was dried for 48 hours at 45° C. using a circulating drier. The dried cake was sieved using a screen having openings of 75 μm. Thus a toner 14 was prepared.

EXAMPLE 15

The procedure for preparation of the toner 15 was repeated except that the pigment/wax dispersion 5 was replaced with the pigment/wax dispersion 8. Thus, a toner 15 was prepared.

Preparation of Organic Particle Emulsion

Manufacturing Example 8-2

In a reaction vessel equipped with an agitator and a thermometer, 683 parts of water, 11 parts of a sodium salt of sulfate of an adduct of methacrylic acid with ethylene oxide (EREMINOR RS-30 from Sanyo Chemical Industries, Ltd.), 111 parts of styrene, 83 parts of methacrylic acid, 55 parts of butyl acrylate, 28 parts of perpenthafluoroacrylate, dibvinylbenzene and 1 part of ammonium persulfate were contained and agitated for 15 minutes at a revolution of 400 rpm. As a result, a white emulsion was prepared. The emulsion was heated to 75° C. to perform a reaction for 5 hours. In addition, 30 parts of a 1% aqueous solution of ammonium persulfate were added thereto and aged for 5 hours at 75° C. Thus, an aqueous dispersion (particle dispersion 2) was prepared. The volume average particle diameter of the particle dispersion 2 was 0.16 μm when measured with an instrument LA-920.

By drying a part of the particle dispersion 2, resin particles were prepared. The glass transition temperature of the resin particles was 128° C.

(Preparation of Aqueous Phase)

Manufacturing Example 2-3

The manufacturing method 8-2 was repeated except that the fine particle dispersion liquid 2 was replaced with the fine particle dispersion liquid 1. Thus, a aqueous phase 3 was prepared.

Emulsification and Solvent Removal

EXAMPLE 16

The following components were contained in a contained to be mixed for 1 minute using a TK HOMOMIXER (manufactured by Tokushu Kika Kogyo Co., Ltd.) at a revolution of 5,000 rpm.

| | |
|---|---|
| 1. Pigment/wax dispersion 1 | 888 parts |
| 2. Prepolymer 1 | 146 parts |
| 3. Ketimine compound | 6.2 parts |

Then, 1960 parts of the aqueous phase 3 were added thereto and the mixture was dispersed for 20 minute using a TK HOMOMIXER at a revolution of 13,000 rpm. Thus, an emulsion slurry 4 was prepared.

In a container equipped with a stirrer and a thermometer, the emulsion slurry 4 was added and then was heated at 30° C. for 8 hour to remove the solvents therefrom. Then the slurry was aged at 50° C. for 8 hours to prepare a dispersion slurry 4.

EXAMPLE 17

The procedure for preparation of the toner 17 was repeated except that the pigment/wax dispersion 5 was replaced with the pigment/wax dispersion 8. Thus, a toner 17 was prepared.

Comparative Example 1

In a container, 709 parts of deionized water and 451 parts of a 0.1 mole aqueous solution of $Na_3PO_4$ were mixed. After the mixture was heated to 60° C., the mixture was agitated with a TK HOMOMIXER at a revolution of 12,000 rpm. Then 68 parts of a 1.0 mole aqueous solution of $CaCl_2$ were gradually added thereto to prepare an aqueous medium including $Ca_3(PO_4)_2$. Then 170 parts of styrene, 30 parts of 2-ethylhexyl acrylate, 10 parts of a carbon black (REGAL400R from Cabot Corp.), 60 parts of paraffin wax having a softening point of 70° C., 5 parts of a metal compound of di-tert-butyl salicylate and 10 parts of a styrene-methacrylic acid copolymer having a weight average molecular weight of 50,000 and an acid value of 20 mgKOH/g were mixed in a container and the mixture was heated to 60° C. Then the mixture was agitated with a TK HOMOMIXER at a revolution of 12,000 rpm to be uniformly dissolved and dispersed. Then 10 parts of a polymerization initiator, 2,2'-azobis(2,4-dimethylvaleronitrile) were dissolved therein. Thus, a polymerizable liquid was prepared.

This polymerizable liquid was added to the above-prepared aqueous medium and the mixture was agitated for 20 minutes at 60° C. using a TK HOMOMIXER at a revolution of 10,000 rpm under a nitrogen atmosphere. The thus prepared polymerizable monomer particles dispersion was reacted for 3 hours at 60° C. while agitated with a paddle agitator. Then the liquid was heated to 80° C. and further reacted for 10 hours.

After completion of the reaction, the liquid was cooled and hydrochloric acid was added thereto-to dissolve calcium phosphate. Then the liquid was filtered and the cake was washed and dried. Thus, a toner 18 was prepared.

Comparative Example 2

It was provided with example 1 except fluorine type activator treatment, then following treatment.

(Cleaning 2 and Air Elutriation)

Fluorine Type Activator Treatment

In container, 630 parts of filtered cake 2, 2928 parts of ion-exchange water were agitated for 5 minutes by three one motor (manufactured by Shinto Science Corp.) at revolution of 4,000rpm.

The mixture composition was heated for 30° C. at 60° C.

The mixture was filtered, and was dried for 48 hours at 45° C. using a circulating drier. The dried cake was sieved using a screen having openings of 75 μm. Thus a toner 20 was prepared.

Comparative Example 3

The procedure for preparation of the toner 20 was repeated except that the filtered cake 1 was replaced with the filtered cake 2 which providing Example 5. Thus, a toner 20 was prepared.

100 parts of provided toner, 1.0 parts of hydrophobic silica and 0.7 parts of hydrophobing titania were mixed in a Henshel mixer.

Provided toner physical property was shown in table 1.

5% by weight of toner which treated external additive, and the silicone resin coated copper-zinc ferrite carrier which has 35 μm. were mixed, then the developer was prepared.

Each toner was used with IPSIOcolor8000 remodeling machine made by Ricoh, and 50000 sheets of image area rate 5% chart continuity horsepower endurance test was executed.

The results are shown in table 2.

The evaluation items are as follows.

(1) Particle Diameter (Dv, Dn)

The particle diameter (i.e., volume average particle diameter and number average particle diameter) of a toner was measured with a particle diameter measuring instrument, COULTER COUNTER TAII, manufactured by Coulter Electronics, Inc., which was equipped with an aperture having a diameter of 100 μm.

(2) Spherical Degree (S.D.)

The spherical degree can be measured by a flow type particle image analyzer FPIA-2100 manufactured by Toa Medical Electronics Co., Ltd. The average spherical degree of each toner was determined.

The specific procedure is as follows:

1) a surfactant serving as a dispersant, preferably 0.1 ml to 5 ml of an alkylbenzenesulfonic acid salt, is added to 100 ml to 150 ml of water from which solid impurities had been removed;
2) 0.1 g to 0.5 g of a sample to be measured is added into the mixture prepared in (1);
3) the mixture prepared in (2) is subjected to an ultrasonic dispersion treatment for about 1 to 3 minutes such that the concentration of the particles is 3,000 to 10,000 particles per microlitter; and
4) the shape and average particle diameter distribution of the sample are determined using the instrument mentioned above.

(3) XPS

An amount of fluorine and carbon of toner particle surface in the present invention can measure by the following technique.

The apparatus used XPS (X-ray photoelectron spectroscopy) method.

The way of measuring it that the same result can provide, a device kind and a condition are not particularly limited.

It is the following condition preferably.

Apparatus: X-ray photoelectron spectrometry (Type 1600S manufactured by ULVAC-PHI Inc.)

X-ray source: Mg K α (400W)

Analysis region: 0.8 mm×2.0 mm

Preparation and Measured;

A sample is crammed in aluminum plate. A sample was glued to the sample holder by carbon seat after that. Then, a sample was measured.

Face Atom Density Calculation;

Relative sensitivity factor of PHI's factor was used.

A measurement area is specially a territory on the surface of the toner of about the some nm.

In addition, as a result of being provided, it is atomic % (atom number %).

(4) Charge Quantity (Q/M)

6 grams of a developer were contained in a closed metal cylinder and subjected to a blow-off treatment to determine the charge quantity of the toner. In this case, the toner concentration of the developer was adjusted so as to range from 4.5% to 5.5% by weight.

(5) Background Fouling

When a white image was developed with each toner, the operations of the copier were stopped. The toner particles present on the surface of the photoreceptor was transferred to an adhesive tape. The reflection densities of the adhesive tapes with or without toner particles were measured with a spectrodensitometer 938 manufactured by X-Rite to determine the difference in reflection density between the adhesive tape with toner particles and the adhesive tape without toner particles.

(6) Cleanability

The toner particles remaining on the photoreceptor were transferred on a SCOTCH adhesive tape manufactured by Sumitomo 3M Limited. The adhesive tape with the toner particles was adhered to a white paper to measure the reflection density thereof. The cleanability was evaluated by classifying as follows:

o: the difference in reflection density is not greater than 0.01.

x: the difference in reflection density is greater than 0.01

TABLE 1

| | | particle size distribution of Toner | | | | | | |
|---|---|---|---|---|---|---|---|---|
| | | volume particle diameter Dv | weight particle diameter Dn | Dv/Dn | Toner shape spherical | XPS | | |
| | Toner No. | [μm] | [μm] | [—] | degree | F | C | F/C |
| Ex. 1 | Toner 1 | 5.26 | 3.89 | 1.35 | 0.97 | 2.24 | 74.56 | 0.03 |
| Ex. 2 | Toner 2 | 5.92 | 4.13 | 1.42 | 0.96 | 3.20 | 72.37 | 0.04 |
| Ex. 3 | Toner 3 | 5.40 | 4.01 | 1.35 | 0.97 | 3.17 | 78.30 | 0.04 |
| Ex. 4 | Toner 4 | 5.76 | 4.23 | 1.36 | 0.95 | 4.38 | 76.91 | 0.06 |
| Ex. 5 | Toner 5 | 5.16 | 3.87 | 1.33 | 0.97 | 1.18 | 80.15 | 0.01 |
| Ex. 6 | Toner 6 | 5.83 | 4.20 | 1.39 | 0.97 | 3.46 | 75.88 | 0.05 |
| Ex. 7 | Toner 7 | 5.55 | 4.36 | 1.27 | 0.96 | 3.09 | 79.22 | 0.04 |
| Ex. 8 | Toner 8 | 5.49 | 4.34 | 1.26 | 0.95 | 3.87 | 76.37 | 0.05 |
| Ex. 9 | Toner 9 | 5.08 | 4.48 | 1.13 | 0.96 | 8.45 | 74.56 | 0.11 |
| Ex. 10 | Toner 10 | 5.47 | 4.77 | 1.15 | 0.96 | 9.68 | 72.02 | 0.13 |
| Ex. 11 | Toner 11 | 5.65 | 4.92 | 1.15 | 0.97 | 10.22 | 73.94 | 0.14 |
| Ex. 12 | Toner 12 | 5.33 | 4.68 | 1.14 | 0.97 | 9.91 | 78.20 | 0.13 |
| Ex. 13 | Toner 13 | 5.13 | 4.45 | 1.15 | 0.96 | 6.41 | 74.81 | 0.09 |
| Ex. 14 | Toner 14 | 5.01 | 4.40 | 1.14 | 0.97 | 28.18 | 75.02 | 0.38 |
| Ex. 15 | Toner 15 | 5.29 | 4.59 | 1.15 | 0.96 | 19.60 | 71.71 | 0.27 |
| Ex. 16 | Toner 16 | 5.11 | 4.34 | 1.18 | 0.96 | 36.29 | 75.69 | 0.48 |
| Ex. 17 | Toner 17 | 5.44 | 4.81 | 1.13 | 0.97 | 24.37 | 76.74 | 0.32 |
| Co-Ex. 1 | Toner 18 | 6.28 | 5.60 | 1.12 | 0.98 | — | — | — |
| Co-Ex. 2 | Toner 19 | 5.26 | 3.92 | 1.34 | 0.97 | — | — | — |
| Co-Ex. 3 | Toner 20 | 5.18 | 3.88 | 1.34 | 0.97 | — | — | — |

TABLE 2

| | | Charge Quantity (Q/M) | | | Background Fouling | | | Cleanability | | |
|---|---|---|---|---|---|---|---|---|---|---|
| | Toner No. | Initial | 10,000th image | 100,000th image | Initial | 10,000th image | 100,000th image | Initial | 10,000th image | 100,000th image |
| Ex. 1 | Toner 1 | 28.7 | 29.6 | 27.1 | 0.02 | 0.03 | 0.08 | ○ | ○ | ○ |
| Ex. 2 | Toner 2 | 29.4 | 32.8 | 33.1 | 0.01 | 0.03 | 0.06 | ○ | ○ | ○ |
| Ex. 3 | Toner 3 | 25.0 | 26.9 | 24.5 | 0.02 | 0.03 | 0.07 | ○ | ○ | ○ |
| Ex. 4 | Toner 4 | 32.0 | 31.9 | 33.8 | 0.01 | 0.04 | 0.06 | ○ | ○ | ○ |
| Ex. 5 | Toner 5 | 26.4 | 27.1 | 27.7 | 0.01 | 0.03 | 0.09 | ○ | ○ | ○ |
| Ex. 6 | Toner 6 | 30.3 | 28.0 | 29.6 | 0.02 | 0.02 | 0.05 | ○ | ○ | ○ |
| Ex. 7 | Toner 7 | 27.2 | 28.6 | 27.3 | 0.02 | 0.01 | 0.07 | ○ | ○ | ○ |
| Ex. 8 | Toner 8 | 28.6 | 28.5 | 29.1 | 0.01 | 0.02 | 0.06 | ○ | ○ | ○ |
| Ex. 9 | Toner 9 | 29.8 | 28.6 | 28.3 | 0.02 | 0.03 | 0.04 | ○ | ○ | ○ |
| Ex. 10 | Toner 10 | 27.9 | 26.5 | 26.4 | 0.02 | 0.03 | 0.03 | ○ | ○ | ○ |
| Ex. 11 | Toner 11 | 28.9 | 27.3 | 27.1 | 0.02 | 0.04 | 0.04 | ○ | ○ | ○ |
| Ex. 12 | Toner 12 | 26.8 | 28.6 | 28.0 | 0.03 | 0.03 | 0.03 | ○ | ○ | ○ |
| Ex. 13 | Toner 13 | 29.5 | 29.3 | 26.9 | 0.03 | 0.05 | 0.06 | ○ | ○ | ○ |
| Ex. 14 | Toner 14 | 27.9 | 27.4 | 27.7 | 0.01 | 0.02 | 0.02 | ○ | ○ | ○ |
| Ex. 15 | Toner 15 | 28.1 | 28.0 | 28.4 | 0.02 | 0.02 | 0.02 | ○ | ○ | ○ |
| Ex. 16 | Toner 16 | 36.3 | 36.9 | 36.7 | 0.02 | 0.01 | 0.02 | ○ | ○ | ○ |
| Ex. 17 | Toner 17 | 38.9 | 38.1 | 38.8 | 0.01 | 0.02 | 0.02 | ○ | ○ | ○ |
| Co-Ex. 1 | Toner 18 | 30.6 | — | | 0.05 | — | — | ○ | — | — |
| Co-Ex. 2 | Toner 19 | 28.3 | 26.4 | | 0.12 | 0.24 | — | x | x | — |
| Co-Ex. 3 | Toner 20 | 37.2 | 42.3 | | 0.10 | 0.46 | — | x | x | — |

The above written description of the invention provides a manner and process of making and using it such that any person skilled in this art is enabled to make and use the same, this enablement being provided in particular for the subject matter of the appended claims, which make up a part of the original description.

All references, patents, applications, tests, standards, documents, publications, brochures, texts, articles, etc. mentioned herein are incorporated herein by reference. Also incorporated herein by reference is Japanese priority application No.2003-75828, filed on Mar. 19, 2003, to which priority is hereby claimed. Where a numerical limit or range is stated, the endpoints are included. Also, all values and subranges within a numerical limit or range are specifically included as if explicitly written out.

The above description is presented to enable a person skilled in the art to make and use the invention, and is provided in the context of a particular application and its requirements. Various modifications to the preferred embodiments will be readily apparent to those skilled in the art, and the generic principles defined herein may be applied to other embodiments and applications without departing from the spirit and scope of the invention. Thus, this invention is not intended to be limited to the embodiments shown, but is to be accorded the widest scope consistent with the principles and features disclosed herein.

What is claimed is:

1. A toner for developing latent electrostatic images, wherein said toner is prepared by:

(A) dissolving or dispersing a toner composition comprising:

(1) a binder resin, and (2) a coloring agent in an organic solvent to prepare a toner composition solution or a toner composition dispersion, (B) dispersing said toner composition solution or said toner composition dispersion in an aqueous solvent to prepare an aqueous dispersion, (C) removing said organic solvent from said aqueous dispersion to prepare toner particles, (D) optionally washing said toner particles to prepare a washed toner, (E) optionally drying said toner particles or said washed toner to prepare the toner, wherein a compound comprising a fluorine atom is added after (C), (D), or (E), wherein the compound comprising a fluorine atom is added in an aquesous medium, and wherein said toner comprises the compound comprising a fluorine atom at a surface thereof, and satisfies a relationship of $0.01<F/C<0.50$ with respect to the content (F) of fluorine atom and (C) of carbon atom, as measured by XPS.

2. The toner as claimed in claim 1, wherein said binder resin comprises a polyester resin.

3. The toner as claimed in claim 2, wherein said polyester resin comprises a polyester resin reactive with at least active hydrogen.

4. The toner of claim 1, wherein the preparation of the toner comprises washing said toner particles to prepare a washed toner.

5. The toner of claim 1, wherein the preparation of the toner comprises drying said toner particles.

6. The toner of claim 1, wherein the preparation of the toner comprises washing said toner particles to prepare a washed toner, and wherein the preparation of the toner also comprises drying said toner particles or said washed toner to prepare the toner.

* * * * *